US006047655A

United States Patent [19]

Cran

[11] Patent Number: 6,047,655

[45] Date of Patent: Apr. 11, 2000

[54] FLEXIBLE BARGE

[75] Inventor: James A. Cran, Calgary, Canada

[73] Assignee: Alta Plan Consultants Ltd., Calgary

[21] Appl. No.: 08/795,537

[22] Filed: Feb. 5, 1997

Related U.S. Application Data

[63] Continuation of application No. 08/099,545, Jul. 30, 1993, abandoned, which is a continuation-in-part of application No. 07/886,651, Apr. 2, 1992, abandoned, which is a continuation of application No. 07/630,895, Dec. 20, 1990, abandoned, which is a continuation-in-part of application No. 07/417,562, Oct. 5, 1989, abandoned, which is a continuation of application No. 07/144,274, Jan. 15, 1988, abandoned.

[51] Int. Cl.[7] ..... B63B 25/08

[52] U.S. Cl. ..... 114/74 T; 114/256

[58] Field of Search ..... 114/74 R, 74 T, 114/256, 257; 405/210

[56] References Cited

U.S. PATENT DOCUMENTS

| | | | |
|---|---|---|---|
| 2,391,926 | 1/1946 | Scott | 114/74 T |
| 2,968,272 | 1/1961 | Berglund | 114/74 T |
| 2,969,036 | 1/1961 | Brown | 114/74 T |
| 2,979,008 | 4/1961 | Whipple | 114/74 T |
| 2,997,973 | 8/1961 | Hawthorne et al. | 114/74 T |
| 2,998,793 | 9/1961 | Hawthorne et al. | 114/74 T |
| 3,001,501 | 9/1961 | Hawthorne et al. | 114/74 T |
| 3,018,748 | 1/1962 | Denis et al. | 114/174 T |
| 3,056,373 | 10/1962 | Hawthorne et al. | 114/74 T |
| 3,067,712 | 12/1962 | Doerpinghaus | 114/74 T |
| 3,150,627 | 9/1964 | Stewart et al. | 114/74 T |
| 3,167,103 | 1/1965 | Hawthorne et al. | 114/256 |
| 3,282,361 | 11/1966 | Mackie | 114/74 T |
| 3,502,046 | 3/1970 | Stauber | 114/74 T |
| 3,779,196 | 12/1973 | Knaus et al. | 114/256 |
| 3,797,445 | 3/1974 | Zeimer | 114/74 T |
| 3,952,679 | 4/1976 | Grihangne | 114/74 T |
| 4,227,477 | 10/1980 | Preus | 114/256 |
| 4,373,462 | 2/1983 | Fish | 114/74 R |
| 4,421,050 | 12/1983 | Weinert | 114/256 |

FOREIGN PATENT DOCUMENTS

| | | |
|---|---|---|
| 1269808 | 7/1961 | France . |

*Primary Examiner*—Jesus D. Sotelo
*Attorney, Agent, or Firm*—Sim & McBurney

[57] ABSTRACT

A novel barge structure for transporting fresh water from one marine environment location to another is described having critical parameters. The barge is constructed of flexible material and preferably is filled to less than 50 percent of its capacity, typically greater than about 25,000 tonnes, so as to float with flat upper and lower surfaces and to have a relatively shallow depth as compared with its length and width. The flexible nature of the structure enables waves to be accommodated without significant stresses which otherwise would require the use of high strength materials. A system of heavy straps acts to prevent propagating rips and to distribute the concentrated tow force over the bag.

11 Claims, 5 Drawing Sheets

FLEXIBLE BARGE

REFERENCE TO RELATED APPLICATION

This application is a continuation of application Ser. No. 08/099,545 filed Jul. 30, 1993, now abandoned which is a continuation-in-part of Ser. No. 07/886,651 filed Apr. 2, 1992, abandoned which is a continuation Ser. No. 07/630,895 filed Dec. 20, 1990, abandoned which is a continuation-in-part of Ser. No. 07/417,562 filed Oct. 5, 1989, abandoned which is a continuation of Ser. No. 07/144,274 filed Jan. 15, 1988, abandoned.

FIELD OF INVENTION

The present invention relates to a novel structure for a flexible barge to transport large volumes of liquids from one marine location to another.

BACKGROUND TO THE INVENTION

It has long been known to provide flexible floating barge structures for the purpose of transportation of liquids from one location to another. A variety of structures has been suggested in the prior art. In particular, the applicant is aware of the following United States Patents from a search conducted in the facilities of the United States Patents and Trademarks Office:

| | | |
|---|---|---|
| 2,391,926 | 3,018,748 | 3,502,046 |
| 2,968,272 | 3,056,373 | 3,779,196 |
| 2,979,008 | 3,067,712 | 3,952,679 |
| 2,997,973 | 3,150,627 | 4,227,477 |
| 2,998,793 | 3,167,103 | 4,373,462 |
| 3,001,501 | 3,282,361 | 4,421,050 |

The devices described in this prior art are of generally complex structure and of limited capacity. Such barges that have been reduced to practice are tubular in cross-section and have a high ratio of length-to-width, typically greater than about 20:1. One of the fundamental problems with which barges are required to deal is wave motion in a marine environment which, in many instances, demands the use of high strength, heavy and expensive materials of construction.

In the parent and grand-parent applications, the Examiner also has cited the following additional prior art:

U.S. Pat. No. 3,797,445; and

French Patent No. 1,269,808

In particular the Examiner has relied on French patent No. 1,269,808 to SOMAF.

SOMAF discloses a rectangular pillow tank and relates to a technique for tipping the pillow tank on its side by the use of a weight and float arrangement. The tank is flexible and comprises of an envelope of rubber, resistant to the material to be transported. The tank is formed from a single sheet of material, folded on itself and joined on three sides. The tank is filled with liquid hydrocarbon, which causes the tank to float on water with its horizontal and transverse edges lying in a plane.

The pillow shape that the tank assumes when filled with hydrocarbon liquid has continuously curved upper and lower surfaces. As will be seen from the description of the invention below, the structure of the flexible barge provided by the present invention contrasts markedly with this structure, in that the structure of the present invention has substantially planar and parallel upper and lower surfaces, that is the upper and lower surfaces lie in planes that are parallel one to another, in contrast to the continuously curved surface in the prior art.

SUMMARY OF INVENTION

In accordance with the present invention, there is provided a novel barge structure which permits large volumes of liquid of density less than sea water to be transported in a marine environment from one location to another and which readily accommodates wave motion without the necessity for high strength and heavy materials.

In the present invention, a flexible barge structure for transportation of a liquid of density less than sea water, preferably fresh water in a marine environment comprises a unilocular hollow flexible bag having a generally planar configuration. The bag is not filled to capacity in use but rather is filled to less than about 75 percent, preferably less than 50%, of its capacity with the liquid. The bag is structured such that, when filled to a proportion of its capacity and floating in sea water, the barge has substantially flat or planar upper and lower surfaces and a length-to-depth ratio of from about 2:1 to about 50:1, a width-to-depth ratio of from about 2:1 to about 20:1 and a length-to-width ratio of from about 1:1 to about 20:1.

By providing a shallow and relatively wide structure, waves in the marine environment cause no problems, enabling the bag to be constructed of lesser strength materials relative to the size of the barge than have traditionally been used. This arrangement permits very large bags to be constructed out of conventional fabrics of reasonable cost.

DESCRIPTION OF PREFERRED EMBODIMENT

Figures 1, 2, 3:
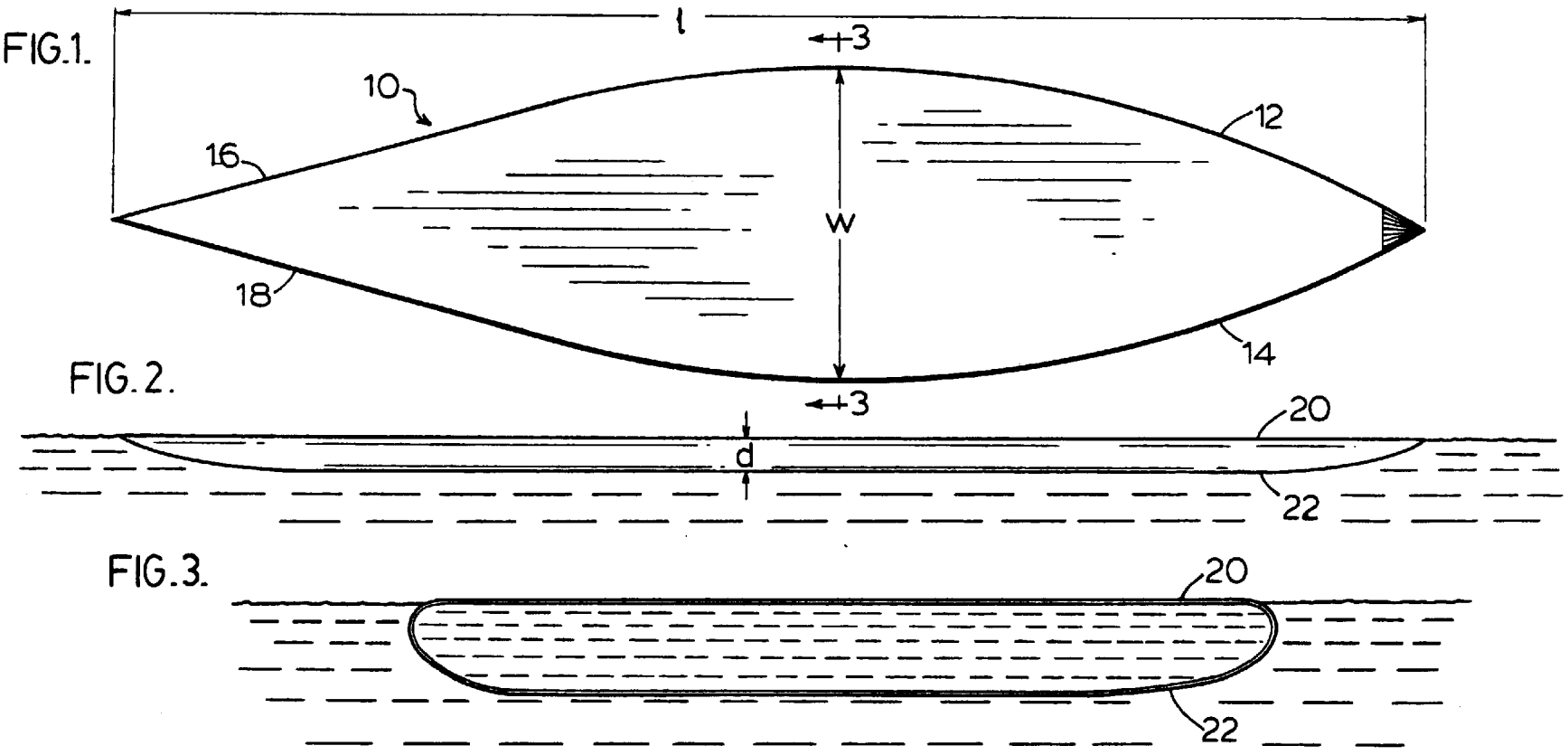
FIG. 1 is a plan view of a barge constructed in accordance with one embodiment of the invention.
FIG. 2 is a side elevational view of the barge of FIG. 1 in a marine environment.
FIG. 3 is a sectional view taken on line 3—3 of FIG. 1.

Referring to the drawings, a flexible barge 10 is constructed in accordance with one preferred embodiment of the invention with a streamlined shape in plan. The periphery of the barge 10 is defined, towards the forward end, by a pair of opposed arcs 12, 14 of a circle and, towards the rearward end, by a pair of straight lines 16, 18 extending tangentially with respect to the arcs 12, 14 of a circle. When seen in elevation, the barge 10 has planar upper and lower surfaces 20 and 22, which are parallel to one another.

The plan view shape of the barge 10 is achieved by appropriate shaping of the fabric of the barge 10 while the elevational view shape of the barge is achieved by filling the barge to preferably less than 50 percent of its capacity, typically about 44 percent of its capacity. With the complex shape illustrated in the Figures, the actual degree of fill of the barge 10 varies with the cross-sectional dimension along the barge length from about 30 to about 100 percent.

The plan view shape illustrated in a preferred one since the streamlined shape decreases the drag experienced by the barge when towed through a marine environment and provides stability against yawing and similar rotating motion instabilities. As seen in FIG. 1, the streamlined shape is defined, at the bow end, by a pair of opposed arcs of a circle intersecting at the bow and, at the stern end, by a pair of straight lines intersecting at the stern and formed tangent to the aforementioned arcs of a circle, so that the angle between the straight lines at the stern is approximately half the angle between the arcs of a circle at the bow. Other shapes are possible embodying the principles hereof.

The slack in the barge 10 resulting from less than 50 percent filling of the capacity of the barge enables the barge 10 to flex sufficiently that waves do not cause any significant problem which would necessitate high strength fabrics and the like. The barge 10 may be constructed of a material which permits stretching, for example, up to about 10 percent, to absorb the wave motion.

The shape of the barge 10 is the preferred one and a considerable variation in shape may be made while still adhering to the principles of the invention. The length to maximum width ratio (1:w) of the barge 10 may vary upwardly from about 1:1 up to about 20:1. The length to depth ratio (1:d) of the barge 10 may vary upwardly from about 2:1 up to about 50:1. The maximum width to depth ratio (w:d) of the barge 10 may vary upwardly from about 2:1 to about 20:1. Particularly preferred ratios are 1:w=about 4:1, 1:d=about 38:1 and w:d=about 9:1.

The most critical parameter of the barge 10 from the point of view of fabric strength is the depth of the bag. The term "fabric strength" refers to the strength of the base fabric material when used alone and to the strength of the compound fabric when both a base fabric and a strapping system are used, as described below. Generally, the force in the fabric increases with the square of the depth in accordance with the formula:

$$\text{fabric stress (lbs/ft)} = \frac{1}{4}\rho^2\left[\frac{1}{\rho} - \frac{1}{\rho_s}\right]d^2$$

where $\rho$ is the density of the cargo in lbs/ft$^3$, $\rho_s$ is the density of the marine environment in lbs/ft$^3$ and d is the depth of the bag measured from the middle of the top surface in ft. For a fresh water cargo in a typical sea-water environment, the equation simplifies to:

$$\text{fabric stress (lbs/ft)} = 0.366d^2$$

Accordingly, it is preferred to operate with shallow depths and large ratios of length and width of barge to depth, therefore, are preferred.

In constructing a barge in accordance with the invention, the maximum operating depth of the barge 10 first is decided upon and then the bag is constructed from material which has a strength suitable for that depth. In use, the bag is filled with liquid to no more than the design operating depth. The design operating depth of the barge 10 is based on economic factors including fabric cost, towing costs etc.

As noted previously, the barge is designed with sufficient flexibility to accommodate the water motion associated with the passage of large waves. To achieve this result, the fabric is provided with sufficient strength that areas of high tension in the fabric of the bag can be relieved by motion of the fabric from areas of lower tension within the time permitted by the waves. As the fabric as a whole increases in tension due to the passage of waves, the bag automatically adjusts to become deeper, thereby decreasing its perimeter of cross-section and permitting the tension to decline back to close to the static value. The low degree of fill of the barge permits this effect to occur. During certain periods of use, for instance, in the passage of large waves, the fabric of the barge will go into a compressed state i.e. zero tension and surface ripples, from which state the stretch experienced by the fabric in accommodating the next wave is minimized and the fabric is specifically designed to be able to accept such stretches as it is required to. This is accomplished by employing relatively elastic fibres, such as nylon and polyester, in a fabric construction which can contribute elongation in addition to that obtained by straining the fibres (e.g. a warp knit).

With such elastic behaviour in the walls of the bag, it is possible for a wave train of constant period to set up resonant oscillations in the contents of the bag. Such resonant oscillations are mitigated by providing non-parallel side walls, which avoid the situation where internal waves are reflected back and forth repeatedly at the same cross-section. In addition, the maximum dimensions of the barge generally are chosen so that the periods of such large and damaging waves as may be encountered in the ocean where that particular barge is to be deployed are much shorter than the period of primary resonance at the mid-point of the bag. For this reason, the preferred width of the bag is quite large. The higher harmonics of large waves or the primary harmonics of small waves are not of concern. As a result of these precautions, there is no need for interior baffles or partitions to mitigate resonant oscillations and a unilocular structure may be employed.

The barge 10 has particular utility in the transportation of large volumes of fresh water from one location to another. Other liquids having a density less than that of sea water also may be transported as cargo, such as, raw sewage or treated sewage effluent. The barge 10 preferably is dimensioned to provide a capacity of at least about 25,000 tonnes, more preferably at least about 500,000 tonnes, which is considerably in excess of any commercial device of which the applicants are aware. The barge 10 preferably is filled to less than 50 percent of its capacity in use, as noted earlier.

Dimensions of the barge 10 which enable capacities of such magnitude to be achieved are a length of 3400 ft, width of 800 ft, depth of 88 ft and an internal volume to hold 4 million tonnes of water at 44 percent of capacity.

The barge may be fabricated in any desired manner, preferably in a completely flattened conformation. For example, two sheets of fabric may be cut to the desired plan shape and joined at their adjacent edges by suitable means consistent with the material of construction. For example, heat welding or solvent welding may be used if certain polymeric materials have been employed as the substance coating the fabric. Sewing may be necessary in addition.

Fabricated in the above manner, the bag is not a body of revolution or, in particular, tubular, as are most of those mentioned in the prior art described above. When deployed in a water body, the bag has two positions of stability, either with the "top" surface up or the "top" surface wholly underwater. In practice, the top and bottom surfaces are indistinguishable and the bag may be periodically turned over to equalize damage due to sun and weather and to kill marine growth.

One convenient material of construction is a water-resistant elastomer-coated mesh material, such mesh material being constructed of polymeric material having some inherent elasticity, such as polyester or nylon. A warp knit mesh construction is preferred. The mesh material also may be steel mesh, preferably hexagonal netting of drawn steel wire or similar high modulus material, such as extended-chain crystallized polymer.

The strength of the material of construction is usually determined as a safety factor multiple (f), usually at least about 3, preferably up to about 20, of the fabric stress to be borne by the base fabric material (determined as described above), which, in turn, is dependent on the depth of the barge, as noted above, taking into account any weakening at the seams. Generally, the base fabric is provided with an elastomeric coating for the purposes of providing waterproofness as well as protecting the material of construction from ultraviolet degradation and marine growth.

Figure 4:
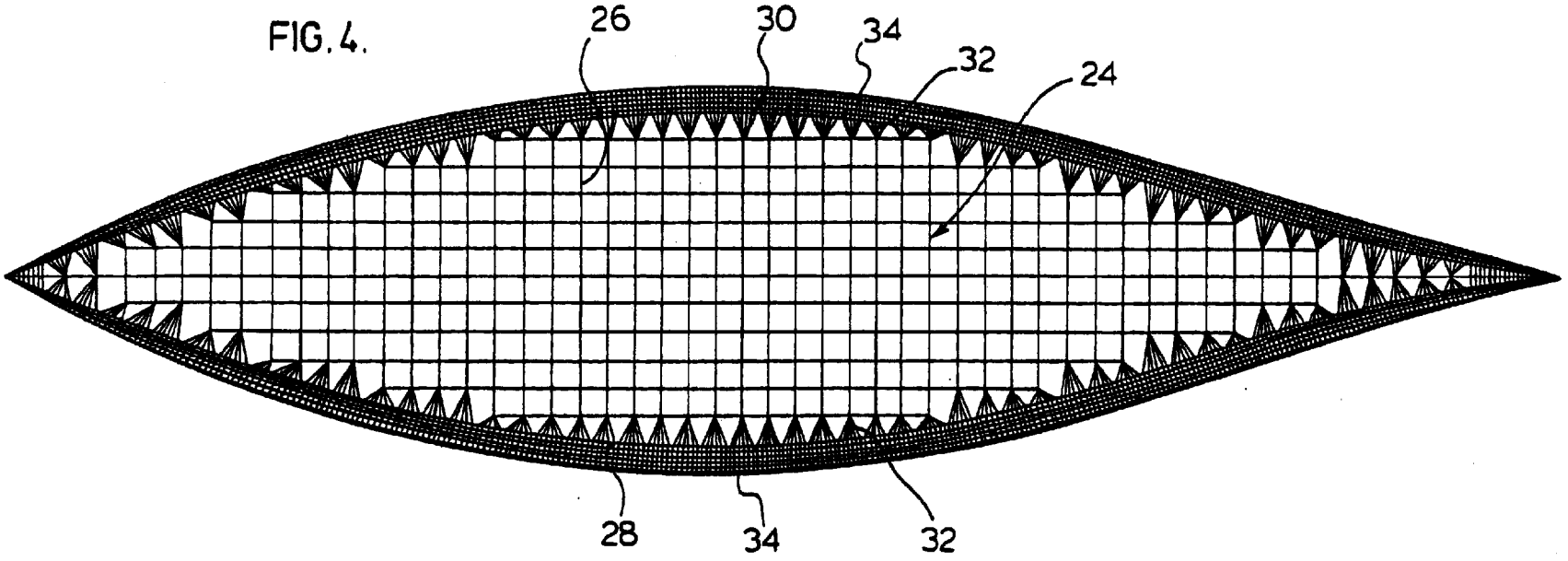
FIG. 4 is a plan view of a strapping pattern for the barge of FIG. 1.

It is preferred to provide a compound fabric comprised of heavy strapping attached to the base fabric of particular size and strength and according to a particular pattern, to prevent propagating rips in the fabric and to permit a range of tow and mooring forces to be transferred to the barge 10 as a whole. One such strapping arrangement is shown in FIG. 4.

The actual pattern of strapping employed depends on the needs of different areas of the barge 10. In particular, the strapping pattern differs at the edges of the structure from that in the planar areas on the top and bottom surfaces of the barge.

A different pattern again is required where the sides and upper or lower surfaces of the barge merge, so as to permit effective transference of forces. Since the predominant shape of the barge 10 is planar, the side pattern changes continuously relative to the orientation of strapping patterns on the top and bottom surfaces 20, 22 of the barge 10.

The relative fabric stress on the barge 10 carried by the base fabric and by the strapping material may be varied by altering the relative strengths of those materials. Generally, the strapping, when present, may carry up to about 80 percent of all forces applied to the compound structure of base fabric and attached strapping. The strapping may be constructed of multiple layers of highly-oriented yarns of the same fiber as the base fabric, covered with the same elastomeric coating as the base fabric.

As an increasing proportion of the total forces are carried by strapping, the base fabric may be decreased in strength and weight. At the same time, seams in the base fabric are subjected to less stress and can be more easily and efficiently made, for example, by heat or solvent welding alone, obviating any need for sewing.

The critical rip length of the compound fabric varies, depending on the strength and weight of the base fabric as well as the distance between the straps in the strapping pattern. Accordingly, the strapping pattern may be designed to achieve particular critical rip lengths.

For the provision of a square strapping pattern 24 (FIG. 4) on the upper and lower surfaces 20, 22 of the barge 10, the strength of the individual straps 26 required to be employed for a particular size of barge 10 can be determined.

As mentioned above, the design fabric stress or tension T is determined by the relationship:

$$T\ (\text{fabric stress (lbs/ft)}) = \frac{1}{4}\rho^2\left[\frac{1}{\rho} - \frac{1}{\rho_s}\right]d^2$$

where $\rho$, $\rho_s$ and d are defined above. The relationship applies also for the combined fabric. The design strength required (TF) then is a multiple of this value T with F, to provide the required safety factor, also as described above.

The base fabric strength then is determined and generally is selected from commonly-available suitable fabric having a tensile strength varying in the range of about 200 to about 600 lbs./in. and normally is in the range of about 20 to about 40% of the design strength. Such a base fabric is required to withstand normal wear and tear as well as walking on its surface by fabricators and crew.

The actual critical rip length ($R_0$, in ft.) is normally no more than the width of the barge 10. The strapping pattern over the planar upper and lower surfaces of the bag is approximately square in plan view, as seen in FIG. 4, with straps of generally about 6 inches to about 2 feet in width spaced generally about 20 to about 60 feet apart, one from another.

The number of such square panels in the critical size length is given by the relationship:

$$n=R_0/W$$

where the factor W is determined by the equation:

$$W=R_0/(2F_s-1)$$

where $F_s$ is given by:

$$F_s=(TF-\text{base fabric strength})/T$$

$F_s$ is the safety factor for the straps alone, and generally is in the range of about 5 to about 10. n generally is in the range of about 10 to 14, so that when $R_0$ is the bag width, there are about 10 to 14 panels across the bag at its widest point.

The strap strength is given by the relationship:

$$S_s=\tfrac{1}{2}T(R_c+W)$$

which may be written as:

$$S_s=F_sTW$$

Thus, two unbroken straps, one at each end of the rip, are required to be strong enough to support the tension acting on all ripped panels within $R_c$, plus an additional half panel each (the remaining half of their normal loads).

A range of tow and mooring forces must be capable of being transferred to the barge 10 and its contents. These forces may be transferred by way of heavy straps which are attached to the barge structure.

Four straps 28, 30 may be provided passing from bow and stern, two on the upper surface and two on the lower surface, with the upper strap being located just above the water-line and the lower strap being located a similar distance from the equator line of the structure on the lower surface. The equator line is the extreme perimeter of the bag when laid flat and is generally the top line when the top and bottom surfaces are joined together.

The strength of strap employed for this purpose should be the greater of approximately five times the anticipated tow force or the strap strength as determined above for the upper and lower planar surfaces of the barges.

The four tow straps are joined at bow and stern with the joint being sufficiently strong to bear all anticipated forces, considering that the two pairs of tow straps meet at angles which are approximately 30 degree from the longitudinal axis of the barge.

The tow straps 28, 30 accept the force from the towline of the tug or other vessel pulling the barge and distribute this force over the whole barge structure. The tow straps also act as lateral force distributors between merge straps 32 and edge straps 34. The tow straps 28, 30 also serve a ripstop function similar to the straps in the square pattern or array 24.

It is only at the edges of the barge 10, where the surface of the bag curves in a vertical plane, that there is an outward force normal to the barge surface, as a result of the difference in pressure between the lower density contents of the bag and the marine medium in which the barge 10 and its contents float. This outward force causes a tension in the base fabric.

The edge straps 34 accept this tension and transfer it through the merge straps 28, 30 to the square pattern or array 24 of straps on the upper and lower surfaces 20, 22 of the barge 10. The edge straps 34 are arranged in a square pattern of about one-fifth of the dimension of the square pattern 24 of the straps on the upper and lower surfaces 20, 22 and are about one-fifth of the strength of the straps on the upper and lower surfaces of the barge 10. The edge straps 34 are both perpendicular and parallel to the equator of the barge 10, so that the orientation of the edge straps varies with the orientation of the equator line of the barge 10. Alternatively, the vertical edge straps may be arranged at an angle of 45 degrees to the equator line. However, every fifth edge strap 34 is for rip strap purposes and hence is provided as heavy in weight as the straps on the upper and lower surfaces 20, 22.

In addition to the edge straps 34, the edge area of the barge 10 may be provided of heavier base fabric than in the remainder of the barge 10, to provide additional protection in this region, since the edge of the barge 10 at the water surface is most vulnerable to damage from collision with boats or other floating objects.

Figure 5A:
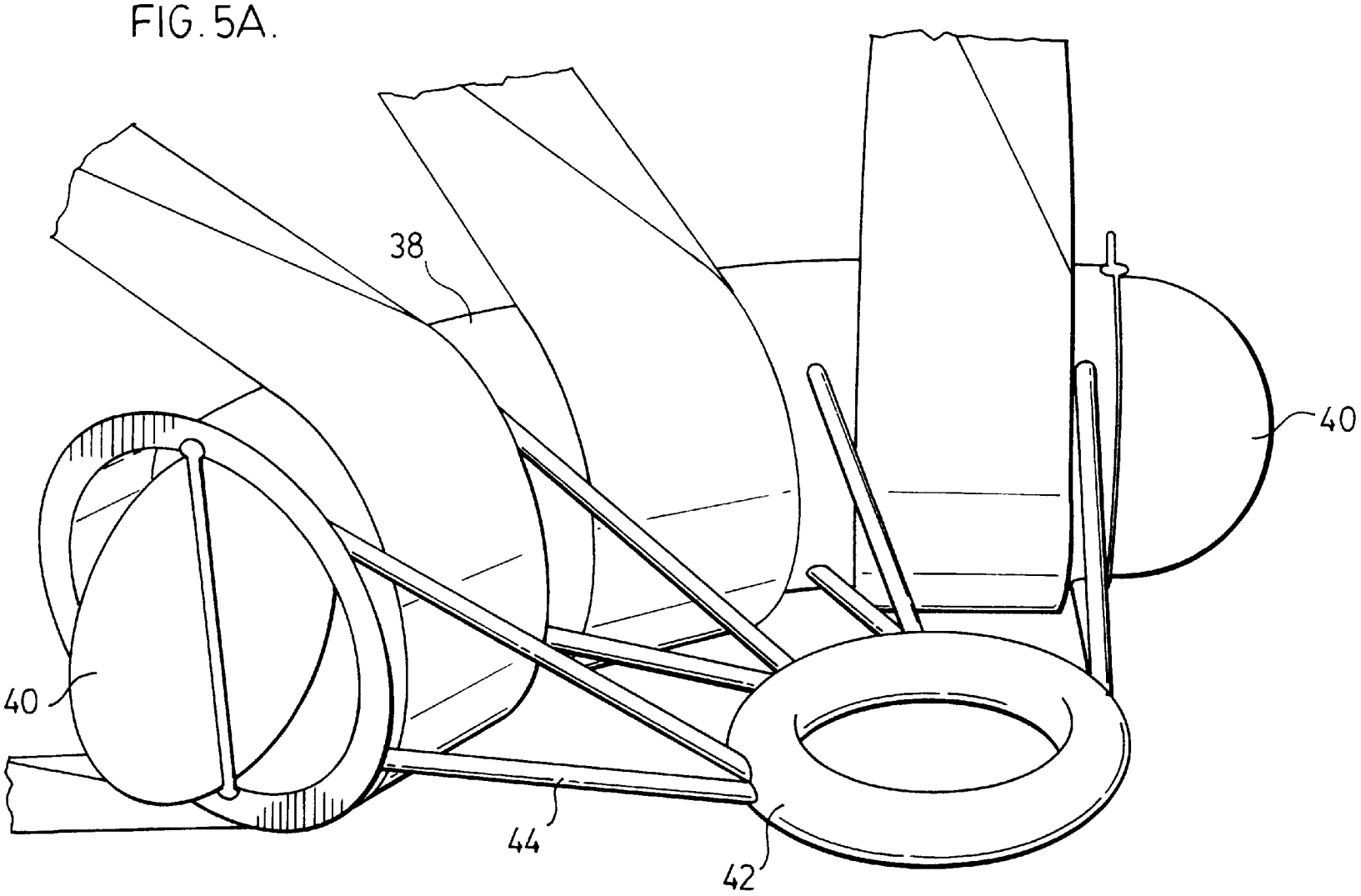
FIGS. 5A, 5B and 5C contain front, side and rear views of details of a bow end structure of the barge of FIG. 1.
Figure 5B:
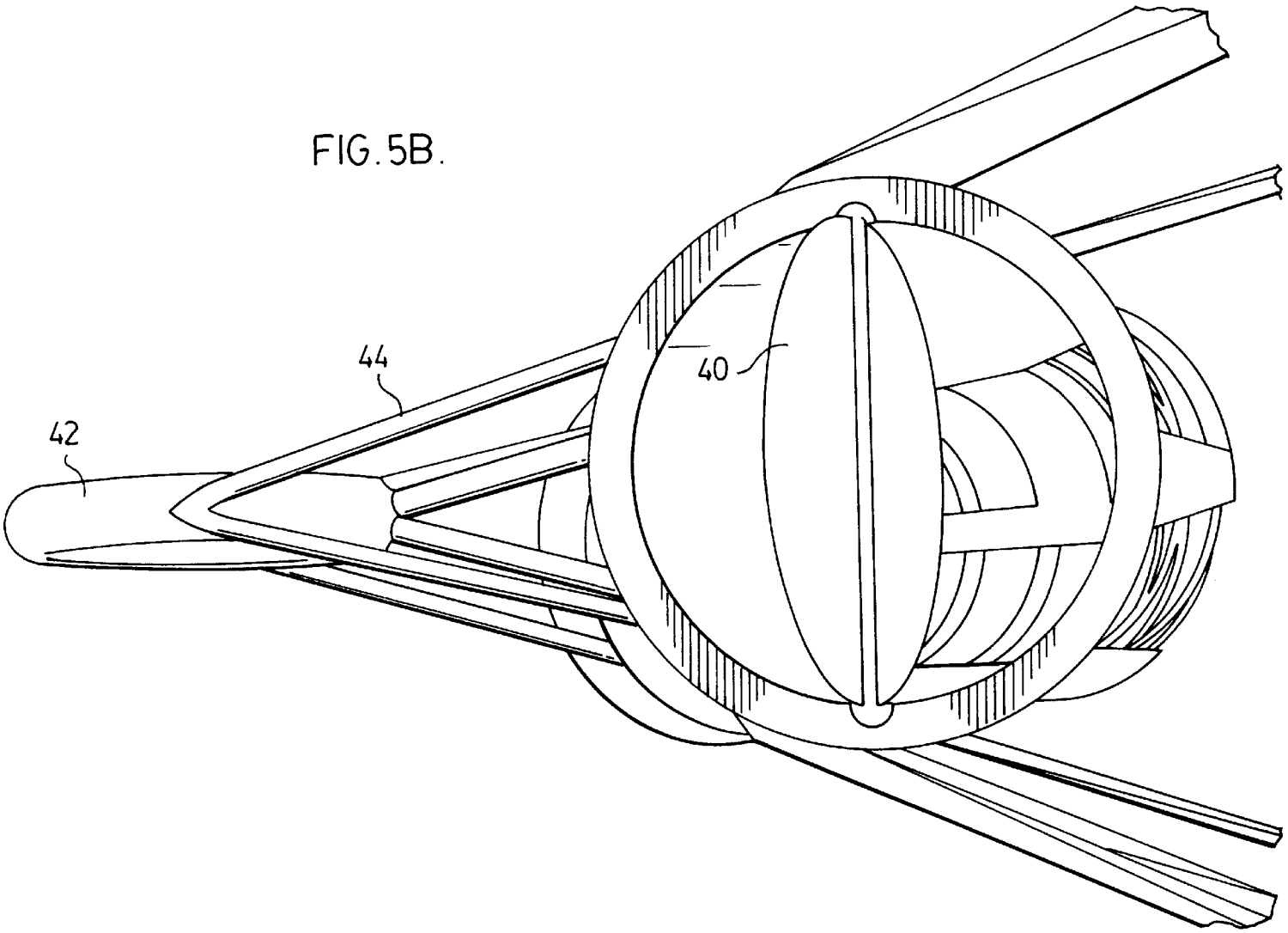
Figure 5C:
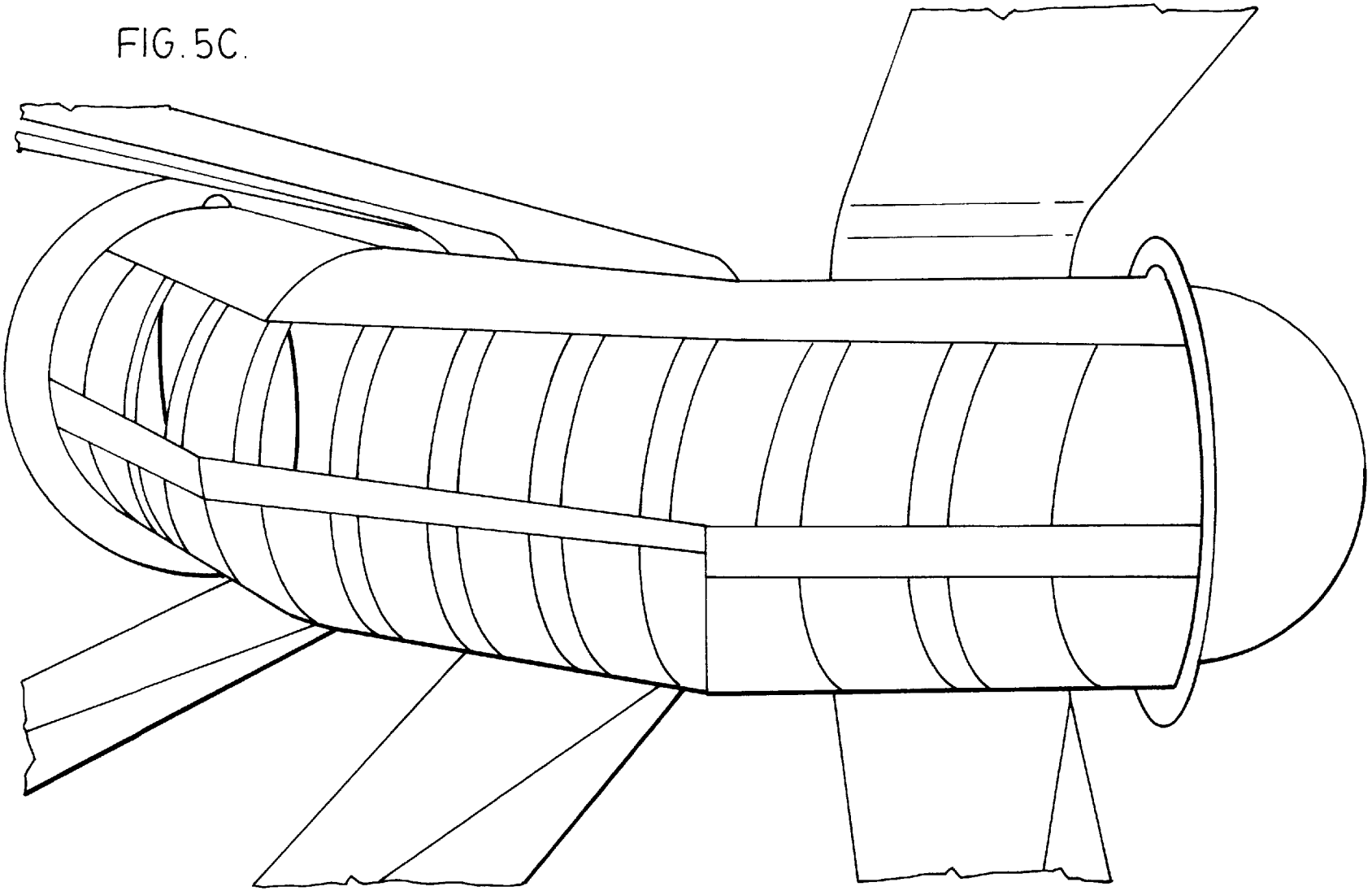

A centre strap 36 of the strapping 24 and the two lateral straps 34 meet at the bow of the barge 10. The tow force can be conveyed to these straps best if they are wrapped around a rigid pipe, which may be steel or possibly fiberglass, or half pipe, which pipe then is connected to the steel tow ring by steel rods welded at each end. Since the straps 34, 36 are angled approximately thirty degrees to each other, the three pipe segments are similarly angled. FIGS. 5A, 5B and 5C illustrate one embodiment of such an arrangement. In FIG. 5, the diameter of the pipe 38 is chosen to be appropriate for the filling and emptying function because the ends of the pipe are designed to also function for the barges as the apertures to the bag. An appropriate diameter is such that the sum of the areas of two apertures is equal to the area of the submarine conduit from the buoy to shore. Typical values are: 228 cm diameter (90 inches) for the conduit and hence 161 cm diameter for the apertures and for the pipe, if the pipe is of circular cross-section, although other configurations may be used. The side of the pipes interior to the bag is cut into slots to permit the water to flow from the bag into the pipes and then out the apertures into mating apertures in the water receiving apparatus or docker which is not shown here, which forms the end of the flexible riser connected to the submarine pipe. The latter apparatus might be part of the buoy or might be separate.

The valves 40 for the apertures shown in this embodiment are butterfly valves. Other possible valve styles may be employed, for example, a door which slides towards the stern or a fabric or rubber sphere or similar structure which is inflated with air or water inside the pipe and blocks the aperture. In the illustrated embodiment, the outside face of the aperture is a planar ring. It may be preferable to have the outside face part of a cylinder (axes about thirty degrees right and left of the axis of the bag) or part of a cone with similar orientation. This may affect the choice of valve type. The flow of water is in the opposite sense at the loading terminal, which otherwise is hydraulically similar.

A similar structure of tow ring 42, pipes 38, valves 40, and connectors 44 from the pipes 38 to the tow ring 42 may be present at the stern of the bag 10. The configuration at the stern generally is different since the straps are typically angled at about fifteen degrees to each other at the location and the size of the aperture may not need to be so large so the pipes may be of smaller diameter. The purpose of such structure at the stern is to permit towing and mooring at the stern and also to permit loading and unloading from the stern which may arise either because rapid loading or unloading is desired or more likely because, while underway, it is designed to unload a relatively small amount of water into a small bag managed by a specially designed tug which can lock onto the stern of the bag, open the valves and conduct, or possibly if necessary pump, water from the large bag into a smaller bag which is being towed behind the special tug.

It is convenient to have the apertures at the bow (or stern) since the bow is always at the sea level, regardless of the state of fill of bag. This arrangement is different from any other point on the equator which starts off at the surface when the bag is empty and is pulled underwater to roughly half the draft of the bag whatever that may be from time to time as the bag fills (or empties). It is also convenient to have the apertures rigidly connected to each other (by the pipes in this embodiment) since, when the bag is empty and floppy the precise location of the apertures would be uncertain and their control difficult, thus jeopardizing the mating maneuver.

In the early stages of emptying, the water inside the bag 10 at sea level is at a significant pressure, a good fraction of one pound per square inch, related to the height the freshwater rises above sea level, typically, about 2.5% of the draft if the sea water has a density of 1.025, as it does in temperate climates. This pressure ensures that water removed from the aperture by the suction of a terrestrial pump station through a submarine pipe and riser is immediately and adequately replaced by other freshwater in the bag. As the bag approaches the totally empty situation, the hydraulic system may remove water from the aperture and its vicinity more quickly than the now very low pressure can replace it so that the pressure may become negative and the fabric collapse about the pipes supporting the aperture. If by careful control and reduction of the flow-rate in the submarine pipe, this undesirable and potentially damaging collapse is avoided, the time required to achieve a desired degree of emptiness may be uneconomically long.

This particular problem may be overcome by providing the bag 10 with the minimum degree of structure necessary to prevent the fabric from collapsing on itself and thus prevent the flow of freshwater. For example, a rigid pipe of diameter similar to the submarine conduit, whose wall is mostly perforated, may run back down the axis of the bag from immediately behind the slots in the bow pipes supporting the apertures to roughly two thirds of the way to the stern. The diameter of this perforated pipe may decline in proportions to its length. If it were planned to completely empty the bag 10 from the stern as well as the bow, then this pipe may continue to the stern and its diameter could proportionally increase through the length of the bag.

A preferred solution to this problem is to provide some stiffness to the fabric of the bag at the equator so that the bag is not able to collapse completely onto itself when the bag approaches an empty condition, but rather is formed into a cylinder or pipe open towards the inside of the bag. This stiffening may be provided in the equator on both sides of the bag so that two pipe-like spaces are provided on each side of the bag whose effective diameter may be adjusted to conduct the necessary volumes of water, i.e. some reasonable fraction of the submarine conduit.

The stiffening may be obtained by incorporating batten-like stiffeners into the fabric. However, the at-rest configuration of the stiffeners must be approximately circular, not flat. The stiffeners may be made of fiberglass or some similarly flexible light weight solid.

The barge 10 of the present invention is intended always to remain floating in a marine environment and, accordingly, need not have the strength or abrasion resistance necessary if the barge 10 were intended to be brought out of the water into land. The resulting lesser strength of fabric means that the barge 10 is of lesser weight and lesser costs are involved in construction. Since the barge is intended to remain in its marine environment, the material of construction desirably is one which permits repairs to be made in situ.

The barge 10 of the present invention may be put to a variety of uses. For example, the barge may be used to transport bulk quantities of fresh water from an abundant source thereof to a remote location requiring such water. The barge 10, partially filled with such water, is towed by suitable tug boats, typically at about two knots, to its destination through the marine environment.

The barge 10 is intended to remain in a marine environment for loading and unloading cargo. The cargo may be loaded through a suitable opening, which may be valved, in the device. Fresh water or other cargo may be pumped from a reservoir to the loading location by using an ocean-floor pipeline terminating in an upward riser to a buoy at the loading station. A similar arrangement may be provided at the location where the cargo is to be off-loaded, with a suitable pump on shore except that a pump also may be provided at the buoy. Particular operating procedures may be adopted which ensure complete emptying of the cargo from the bag.

In addition, when used for transporting fresh water, a second aperture may need to be provided, at the opposite end from the location of the filling/emptying aperture, to permit final emptying of the barge.

When used to haul sewage for dumping in a marine environment, a plurality of small apertures may be provided in the stern of the barge to permit gradual release of the cargo as the barge is towed and rapid large scale dilution of the discharge.

The specific gravity of the barge may be of any desired value which will permit the barge to float or sink when empty, as desired. Partially filling of the barge with fresh water causes the barge to float in the marine environment.

Hauling cables may be attached to the barge 10 in any suitable manner to enable the barge 10 to be hauled from one location to another. Such cables generally are attached to the union of the tow straps 28, 30 so that the highly concentrated towing force to distributed over the bag by the strapping system.

SUMMARY OF DISCLOSURE

In summary of this disclosure, the present invention provides a novel flexible barge which is capable of transportation of large volumes of fresh water from one marine environment to another. Modifications are possible within the scope of this invention.

What I claim is:

1. A flexible marine barge structure, comprising:

a unilocular hollow flexible bag having a generally planar configuration and streamlined in shape in plan view and constructed to receive a cargo of an aqueous medium less dense than sea water, so that said barge floats in sea water when containing said cargo and to a proportion of the capacity of said bag structure such that, when said barge floats in sea water with said cargo, the bag has substantially planar and parallel upper and lower surfaces and a length-to-depth ratio of from about 2:1 to about 50:1, a width-to-depth ratio of from about 2:1 to about 20:1 and a length-to-depth ratio of from about 1:1 to about 20:1, said streamlined shape being defined, at the bow end, by a pair of opposed arcs of a circle intersecting at the bow and, at the stern end, by a pair of straight lines intersecting at the stern and formed tangent to the arcs of a circle, so that the angle between the straight lines at the stern is approximately one half the angle between the area of a circle at the bow.

2. A flexible marine barge structure, comprising:

a unilocular hollow flexible bag having a capacity of at least 25,000 tonnes of liquid cargo and constructed to receive a cargo of liquid sewage effluent less dense than sea water, so that said barge floats in sea water when containing said cargo, and to less than 50% of the capacity of said bag structure such that, when said barge floats in sea water with said cargo, the bag has substantially flat and parallel upper and lower surfaces and a length-to-depth ratio of about 2:1 to about 50:1, a width-to-depth ratio of from about 2:1 to about 20:1 and a length-to-width ratio from about 1:1 to about 20:1, a plurality of small apertures being provided in the equator line of the bag to permit diffusion of said liquid sewage effluent from said barge structure.

3. A flexible marine barge structure, comprising:

a unilocular hollow flexible bag having a generally planar configuration and streamlined in shape in plan view and constructed to receive a cargo of an aqueous medium less dense than sea water, so that said barge floats in sea water when containing said cargo and to a proportion of the capacity of said bag structure such that, when said barge floats in sea water with said cargo, the bag has substantially planar and parallel upper and lower surfaces and a length-to-depth ratio of from about 2:1 to about 50:1, a width-to-depth ratio of from about 2:1 to about 20:1 and a length-to-depth ratio of from about 1:1 to about 20:1, said flexible bag being formed of a water-resistant elastomer-coated mesh material and being provided with an exterior reinforcing strapping structure, said strapping comprising an array of straps which is approximately square in plan view provided on the upper and lower planar surfaces of the bag with each strap dimensioned about 6 inches to about 2 feet in width and spaced about 20 to about 60 feet apart one from another, the overall strength (TF) of the combination of reinforcing strapping structure and said elastomer-coated mesh material being at least three times the fabric stress (T) to be borne by the combination in use, which is determined by the relationship:

$$T\ (\text{fabric stress (lbs/ft)}) = \frac{1}{4}\rho^2\left[\frac{1}{\rho} - \frac{1}{\rho_s}\right]d^2$$

where ρ is the density of the cargo in lbs/ft$^3$, $\rho_s$ is the density of the marine environment in lbs/ft$^3$ and d is the depth of the bag, measured from the middle of the top surface in feet, the number of said square panels (n) being related to a critical rip length ($R_c$) to the elastomer-coated mesh material, in accordance with the relationship:

$$n = \frac{R_c}{W}$$

where $W=R_c/(2F_s-1)$ where $F_s$ is the safety factor of the straps and $$F_s=(TF-\text{base fabric strength})/T.$$

4. The barge structure of claim 3 wherein $F_s$ is in the range of about 5 to about 10 and n is in the range of about 10 to about 14.

5. The barge structure of claim 4 wherein the strength of each individual strap ($S_s$) of the array of square panels is given by the relationship:

$$S_s = \tfrac{1}{2}T(R_s + W).$$

6. A flexible marine barge structure, comprising:

a unilocular hollow flexible bag formed of a water-resistant elastomer-coated mesh material and having a generally planar configuration and a streamlined shape in plan view and constructed to receive a cargo of an aqueous medium less dense than sea water, so that said barge floats in sea water when containing said cargo and to a proportion of the capacity of said bag structure such that, when said barge floats in sea water with said cargo, the bag has substantially planar and parallel upper and lower surfaces and a length-to-depth ratio of from about 2:1 to about 50:1, a width-to-depth ratio of from about 2:1 to about 20:1 and a length-to-width ratio of from about 1:1 to about 20:1, said flexible bag being provided with an exterior reinforcing strapping structure, the overall strength (TF) of the combination of reinforcing strapping structure and said elastomer coated mesh material being at least 3 times ($F_s$) the fabric stress (T) to be borne by the combination in use, which is determined by the relationship:

$$T\ (\text{fabric stress (1lbs/ft)}) = \frac{1}{4}\rho^2\left[\frac{1}{\rho} - \frac{1}{\rho_s}\right]d^2$$

where ρ is the density of the cargo in lbs/ft$^3$, $\rho_s$ is the density of the marine environment in lbs/ft$^3$ and d is the depth of the bag, measured from the middle of the top surface in feet, said strapping comprising an array of straps which is approximately square in plan view provided on the upper and lower planar surfaces of the bag with each strap dimensioned about 6 inches to about 2 feet in width and spaced about 20 to about 60 feet apart one from another;

the strapping further comprising four straps passing from bow to stern of the bag, two of such straps being located on the upper surface of the bag just above the intended water-line of the bag and two of such straps being located a similar distance from the equator line of the structure on the lower surface.

7. The barge structure of claim 6 wherein said strapping further comprises merge strapping joining said bow-to-stern straps to said array of square strapping and edge strapping joining the upper and lower surface pairs of said bow-to-stern straps.

8. The barge structure of claim 7 wherein said edge strapping is formed as an array of straps which is approximately square in plan view, with each strap being dimensioned and spaced one from another about one-fifth the corresponding dimension for the straps in said array on the upper and lower planar surfaces of the bag.

9. The barge structure of claim 8 wherein the region of said bag at which the edge strapping is located is constructed of heavier base fabric construction than the remainder of the bag.

10. A flexible marine barge structure, comprising:

a unilocular hollow flexible bag having a generally planar configuration and streamlined in shape in plan view and constructed to receive a cargo of an aqueous medium less dense than sea water, so that said barge floats in sea water when containing said cargo and to a proportion of the capacity of said bag structure such that, when said barge floats in sea water with said cargo, the bag has substantially planar and parallel upper and lower surfaces and a length-to-depth ratio of from about 2:1 to about 50:1, a width-to-depth ratio of from about 2:1 to about 20:1 and a length-to-depth ratio of from about 1:1 to about 20:1, said barge structure including means for permitting complete emptying of the barge structure, said means permitting complete emptying of the barge structure comprising stiffening means provided adjacent the lateral extremities of the flexible bag defining flow channels at said lateral extremities through which liquid may flow to the unloading end of the bag structure.

11. A flexible marine barge structure, comprising:

a unilocular flexible bag having a generally planar structure and streamlined in plan view formed by overlying two identical planar layers of flexible water-resistant elastomer-coated mesh material and joining the adjacent edges of said layers together to define a unilocular structure having a capacity of at least about 500,000 tonnes of liquid cargo of an aqueous medium less dense than water, such that, upon filling to a proportion of the capacity of the bag and floating on sea water, the bag has substantially planar and parallel upper and lower surfaces and a length-to-depth ratio of from about 2:1 to about 50:1, a width-to-depth ratio of about 2:1 to about 20:1 and a length-to-width ratio of from about 1:1 to about 20:1, said bag being formed of a material having a strength which is from about 3 to about 20 times the fabric stress (T) to be borne by the material of construction in use, which is determined by the relationship:

$$T\ (\text{fabric stress (lbs/ft)}) = \frac{1}{4}\rho^2\left[\frac{1}{\rho} - \frac{1}{\rho_s}\right]d^2$$

where ρ is the density of the cargo in lbs/ft$^3$, $\rho_s$ is the density of the marine environment in lbs/ft$^3$ and d is the depth of the bag measured from the middle of the top surface in ft., said streamlined shape being defined, at the bow end, by a pair of opposed arcs of a circle intersecting at the bow and, at the stern end, by a pair of straight lines intersecting at the stern and formed tangent to the arcs of a circle, where the angle between the straight lines at the stern is approximately one-half the angle between arcs at the bow.

* * * * *